US008311840B2

(12) United States Patent
Giesbrecht et al.

(10) Patent No.: US 8,311,840 B2
(45) Date of Patent: Nov. 13, 2012

(54) FREQUENCY EXTENSION OF HARMONIC SIGNALS

(75) Inventors: David Giesbrecht, Toronto (CA); Phillip Hetherington, Port Moody (CA); Xueman Li, Burnaby (CA)

(73) Assignee: QNX Software Systems Limited, Kanata, Ontario ( * ) Notice: Subject to any disclaimer, the term of this patent is extended or adjusted under 35 U.S.C. 154(b) by 1697 days.

(21) Appl. No.: 11/168,654

(22) Filed: Jun. 28, 2005

(65) Prior Publication Data

US 2006/0293016 A1 Dec. 28, 2006

(51) Int. Cl.
*G10L 19/00* (2006.01)
*G10L 19/14* (2006.01)

(52) U.S. Cl. ..... 704/500; 704/501; 704/200.1; 704/205

(58) Field of Classification Search ..... 704/201, 704/205, 209, 500, 200, 200.1, 203, 204, 704/219, 501
See application file for complete search history.

(56) References Cited

U.S. PATENT DOCUMENTS 4,255,620 A 3/1981 Harris et al.
4,343,005 A 8/1982 Han et al.
4,672,667 A * 6/1987 Scott et al. ..... 704/231
4,700,360 A 10/1987 Visser
4,741,039 A 4/1988 Bloy
4,873,724 A * 10/1989 Satoh et al. ..... 704/218
4,953,182 A 8/1990 Chung
5,086,475 A * 2/1992 Kutaragi et al. ..... 704/265
5,335,069 A 8/1994 Kim
5,345,200 A 9/1994 Reif
5,371,853 A * 12/1994 Kao et al. ..... 704/200.1
5,396,414 A 3/1995 Alcone
5,416,787 A 5/1995 Kodama et al.
5,455,888 A * 10/1995 Iyengar et al. ..... 704/203
5,497,090 A 3/1996 Macovski
5,581,652 A 12/1996 Abe et al.
(Continued)

FOREIGN PATENT DOCUMENTS

EP 0 497 050 A2 8/1992
(Continued)

OTHER PUBLICATIONS

Qian et al, "Combining Equalization and Estimation for Bandwidth Extension of Narrowband Speech," Acoustics, Speech, and Signal Processing, 2004. Proceedings. (ICASSP '04). IEEE International Conference on, May 2004, pp. I-713-I-716.*

(Continued)

*Primary Examiner* — Jesse Pullias
(74) *Attorney, Agent, or Firm* — Brinks Hofer Gilson & Lione

(57) ABSTRACT

A system and methods are provided for extending the frequency bandwidth of a harmonic signal. Harmonic content of a band-limited signal is extended to frequencies outside the signal's passband by performing a non-linear transformation on the complex spectrum of the band-limited signal in the frequency domain. The non-linear transformation may be accomplishes by a linear convolution of the complex spectrum with itself. A system for extending the frequency bandwidth of a harmonic signal includes a signal processor with a forward transform module for transforming a time domain signal into the frequency domain, a non-linear transform module for performing the non-linear transformation on the complex spectrum of the harmonic signal, and a reverse transform module for transforming the extended spectrum of the harmonic signal back into the time domain.

27 Claims, 9 Drawing Sheets

U.S. PATENT DOCUMENTS

| | | | | |
|---|---|---|---|---|
| 5,771,299 | A | 6/1998 | Melanson | |
| 5,950,153 | A * | 9/1999 | Ohmori et al. | 704/217 |
| 6,115,363 | A | 9/2000 | Oberhammer et al. | |
| 6,144,244 | A | 11/2000 | Gilbert | |
| 6,154,643 | A | 11/2000 | Cox | |
| 6,157,682 | A | 12/2000 | Oberhammer | |
| 6,195,394 | B1 | 2/2001 | Arbeiter et al. | |
| 6,208,958 | B1 | 3/2001 | Cho et al. | |
| 6,226,616 | B1 | 5/2001 | You et al. | |
| 6,295,322 | B1 | 9/2001 | Arbeiter et al. | |
| 6,504,935 | B1 | 1/2003 | Jackson | |
| 6,513,007 | B1 * | 1/2003 | Takahashi | 704/258 |
| 6,539,355 | B1 * | 3/2003 | Omori et al. | 704/268 |
| 6,577,739 | B1 | 6/2003 | Hurtig et al. | |
| 6,615,169 | B1 | 9/2003 | Ojala et al. | |
| 6,681,202 | B1 | 1/2004 | Miet et al. | |
| 6,691,083 | B1 | 2/2004 | Breen | |
| 6,704,711 | B2 | 3/2004 | Gustafsson et al. | |
| 6,829,360 | B1 * | 12/2004 | Iwata et al. | 704/E21.011 |
| 6,889,182 | B2 * | 5/2005 | Gustafsson | 704/205 |
| 6,895,375 | B2 * | 5/2005 | Malah et al. | 704/219 |
| 7,181,402 | B2 * | 2/2007 | Jax et al. | 704/500 |
| 7,191,136 | B2 * | 3/2007 | Sinha et al. | 704/500 |
| 7,248,711 | B2 * | 7/2007 | Allegro et al. | 381/316 |
| 7,359,854 | B2 * | 4/2008 | Nilsson et al. | 704/219 |
| 7,461,003 | B1 * | 12/2008 | Tanrikulu | 704/500 |
| 7,546,237 | B2 | 6/2009 | Nongpiur et al. | |
| 2001/0044722 | A1 | 11/2001 | Gustafsson et al. | |
| 2002/0128839 | A1 | 9/2002 | Lindgren et al. | |
| 2002/0138268 | A1 | 9/2002 | Gustafsson | |
| 2003/0009327 | A1 | 1/2003 | Nilsson et al. | |
| 2003/0050786 | A1 | 3/2003 | Jax et al. | |
| 2003/0093278 | A1 | 5/2003 | Malah | |
| 2003/0158726 | A1 | 8/2003 | Philippe et al. | |
| 2003/0187663 | A1 * | 10/2003 | Truman et al. | 704/500 |
| 2004/0028244 | A1 * | 2/2004 | Tsushima et al. | 381/98 |
| 2004/0158458 | A1 | 8/2004 | Sluijter et al. | |
| 2004/0166820 | A1 | 8/2004 | Sluijter et al. | |
| 2004/0174911 | A1 | 9/2004 | Kim et al. | |
| 2004/0264721 | A1 | 12/2004 | Allegro et al. | |
| 2005/0021325 | A1 * | 1/2005 | Seo et al. | 704/207 |
| 2005/0267739 | A1 * | 12/2005 | Kontio et al. | 704/205 |
| 2007/0124140 | A1 | 5/2007 | Iser et al. | |
| 2007/0150269 | A1 | 6/2007 | Nongpiur et al. | |

FOREIGN PATENT DOCUMENTS

| | | | |
|---|---|---|---|
| EP | 0 497 050 | A3 | 8/1992 |
| EP | 0 706 299 | A2 | 4/1996 |
| EP | 0 706 299 | A3 | 4/1996 |
| WO | WO 98/06090 | A1 | 2/1998 |
| WO | WO 01/18960 | A1 | 3/2001 |
| WO | WO 2005 015952 | A1 | 2/2005 |

OTHER PUBLICATIONS

Iser et al, "Bandwidth Extension of Telephony Speech", Eurasip Newsletter, vol. 16, Nr. 2, Jun. 2-24, 2005, pp. 2-24.*

Kornagel, Spectral widening of the Excitation Signal for Telephone-Band Speech Enhancement. Proceedings of the IWAENC, 2001, pp. 215-2181.*

Vary, "Advanced Signal Processing in Speech Communication," in Proceedings of European Signal Processing Conference (EUSIPCO), Vienna, Austria, Sep. 2004, pp. 1449-1456.*

Kornagel, "Improved Artificial Low-Pass Extension of Telephone Speech," International Workshop on Acoustic Echo and Noise Control (IWAENC2003), Sep. 2003, pp. 107-110.*

McClellan et al. "Signal Processing First," Prentice Hall, Lab 07, pp. 1-12.*

"Introduction to DSP", Bores Signal Processing, http://www.bores.com/courses/intro/time/2_concor.htm, Apr. 23, 1998 update, pp. 1-3.*

"Convention Paper" by Audio Engineering Society, Presented at the 115th Convention, Oct. 10-13, 2003, New York, NY, USA (16 Pages).

"Neural Networks Versus Codebooks in an Application for Bandwidth Extension of Speech Signals" by Bernd Iser, Gerhard Schmidt, Temic Speech Dialog Systems, Soeflinger Str. 100, 89077 Ulm, Germany; Proceedings of Eurospeech 2003 (4 Pages).

Office Action dated Sep. 16, 2010 for corresponding Canadian Application No. 2,550,654, 2 pages.

Office Action dated Feb. 11, 2011 for corresponding Canadian Application No. 2,550,654, 2 pages.

* cited by examiner

FREQUENCY EXTENSION OF HARMONIC SIGNALS

BACKGROUND OF THE INVENTION

1. Technical Field

A system and methods for extending the frequency bandwidth of harmonic signals are provided.

2. Prior Art

All communication systems, especially wireless communication systems, suffer bandwidth limitations. The quality and intelligibility of speech signals transmitted in such systems must be balanced against the limited bandwidth available to the system. In wireless telephone networks, for example, the bandwidth is typically set according to the minimum bandwidth necessary for successful communication. The lowest frequency important to understanding a vowel is about 200 Hz and the highest frequency vowel formant is about 3,000 Hz. Most consonants however are broadband, usually having energies in frequencies below about 3,400 Hz. Accordingly, most wireless speech communication systems are optimized to pass between 300 and 3,400 Hz.

A typical passband 10 for a speech communication system is shown in FIG. 1. In general, passband 10 is adequate for delivering speech signals that are both intelligible and are a reasonable facsimile of a person's speaking voice. Nonetheless, much speech information contained in higher frequencies outside the passband 10 is lost due to bandpass filtering. This can have a detrimental impact on both intelligibility and quality in environments where significant amounts of noise are present.

In many cases, the quality of band-limited signals can be improved by reintroducing the harmonic components of signals that have been lost because they lie outside of the system's passband. In some systems, such as that disclosed in a co-pending U.S. patent application Ser. No. 11/110,556, entitled "System for Improving Speech Quality and Intelligibility," the entire disclosure of which is incorporated herein by reference, higher frequency components of speech signals are transposed or compressed into lower frequency ranges that are within the system's passband. In this case the compressed speech signals retain much of the information from the higher frequency ranges that are outside the passband and which would otherwise be lost if the signal were not compressed. This step alone significantly improves the quality and intelligibility of band-limited speech signals. Nonetheless, such frequency compressed signals experience further significant quality and intelligibility improvements if they are re-expanded after they have been transmitted over the narrowband communication channel and harmonics have been reintroduced at higher frequencies.

Presently, several techniques exist for extending the frequency range of harmonic signals for both speech and music. In many cases extending the harmonic signal content may be described as "excitation signal generation." These techniques can be broadly grouped into two categories: frequency shifting methods; and nonlinear distortion methods.

Frequency shifting methods involve some form of spectral copying, transposition, or folding, in order to introduce a replica of lower frequency harmonics at higher frequencies. Many of these methods use a fixed copying scheme, which can result in the improper placement of the high-frequency harmonics. In many cases, the re-introduced high frequency harmonics will not be placed accurately at each multiple of the fundamental pitch frequency. Some spectral copying methods use a pitch estimate to insure the proper placement of transposed harmonics. However, performance of these methods can become severely degraded if the pitch estimate is inaccurate. This is often the case with signals having a low SNR.

The second category of harmonic extension methods involves creating harmonic distortion so that harmonics are introduced across the full frequency spectrum. These methods employ a time domain non-linear transformation such as a squared function $x^2(n)$, cubic function $x^3(n)$, or full-wave rectification $|x(n)|$, to introduce harmonic distortion. These methods are usually followed by spectral envelope estimation techniques, such as linear prediction, which are used to ensure that the final wideband excitation signal is spectrally flat.

The main advantage of non-linear transformation methods over spectral copying or folding methods is that harmonics are generated at multiples of the fundamental frequency without requiring the use of a pitch estimation algorithm. However, the main disadvantage of these techniques is that the new harmonics can contain aliasing artifacts in the higher frequencies. Also, because it is a time domain approach, it is difficult to control the bandwidth of the generated harmonics. New harmonics are generated across all frequencies instead of only the frequency range of interest.

SUMMARY

A system and methods are provided for extending the harmonics of band limited harmonic signals. Harmonic content of a band-limited harmonic signal is extended to frequencies outside the signal's passband by performing a non-linear transformation on the complex spectrum of the band limited signal in the frequency domain. This non-linear transformation may be accomplished by a linear convolution of the complex spectrum with itself. A system for extending the frequency bandwidth of a harmonic signal includes a signal processor with a forward transform module for transforming a time domain signal into the frequency domain, a non-linear transform module for performing the non-linear transformation on the complex spectrum of the harmonic signal, and a reverse transform module for transforming the extended spectrum of the harmonic signal back into the time domain. In many applications, it may be desirable to combine the original band-limited signal with all or some spectral portion of the spectrally-extended harmonic signal (e.g. to obtain a final speech or music signal with improved quality or intelligibility). This can be accomplished using a variety of techniques as described in the co-pending U.S. patent application Ser. No. 11/110,556, entitled "System for Improving Speech Quality and Intelligibility".

According to an embodiment of the invention a method of extending the harmonics of a band-limited harmonic signal is provided. The method calls for transforming the band-limited harmonic signal from the time domain into the frequency domain. The transformation produces a complex spectrum of the band-limited harmonic signal. Once the complex spectrum has been obtained, a non-linear transformation is performed on the complex spectrum. The non-linear transformation may include a linear convolution of the complex spectrum with itself. The non-linear transformation extends the harmonic content of the complex spectrum to frequencies outside the limited frequency band of the original band-limited harmonic signal. Finally, an inverse transform is performed on the extended complex spectrum, transforming the complex spectrum back into the time domain.

According to another embodiment, a harmonic extension method is provided. This method includes receiving a band-limited harmonic signal. By definition, the band-limited harmonic signal includes significant signal energies at regular frequency intervals within the limited frequency band of the band-limited signal. The signal's pass band is defined by a passband lower frequency limit and a passband upper frequency limit. The band-limited harmonic signal is transformed from the time domain into the frequency domain. The time domain to frequency domain transform produces a complex spectrum representing the frequency content of the received signal. In order to add harmonic content to frequencies outside the narrow frequency band of the original signal, a non-linear transformation is performed on the complex spectrum of the received band-limited harmonic signal. The harmonically extended spectrum is then transformed back into the time domain.

A system for extending the harmonics of a band limited harmonic signal is also provided. The system includes a device for receiving a band-limited harmonic signal, such as microphone, a wireless telephone hand set, an audio system, or any other device or system capable of receiving an harmonic signal. The system further includes a signal processor for processing a signal received by the receiving device. The signal processor includes a forward transform module for transforming the received band-limited harmonic signal from the time domain into the frequency domain. The forward transform module generates a complex spectrum representing the frequency content of the band-limited signal. A non-linear transformation module is provided by the signal processor for performing a non-linear transformation of the complex spectrum of the band-limited signal in the frequency domain. The non-linear transformation creates an extended spectrum that includes harmonics at frequencies outside the original frequency band of the received signal. Finally, the signal processor includes a reverse transform module for transforming the harmonically extended spectrum of the band-limited harmonic signal back into the time domain.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE PREFERRED EMBODIMENTS

The present invention relates to a system and methods for extending the frequency bandwidth of harmonic signals. The system and methods may be employed to reintroduce both high and low frequency harmonics of band-limited signals, as well as restore mid-band harmonics that may have been masked by background noise. The system and methods for extending the frequency bandwidth of harmonic signals may be advantageously employed to enhance the quality or intelligibility of harmonic signals such as speech or music signals. Further, the system and methods may provide an optimal mechanism for extending the bandwidth of compressed signals according to the co-pending patent application entitled "System For Improving Speech Quality and Intelligibility," as mentioned in the Background section, the teaching of which is incorporated into the present disclosure.

Figure 3:
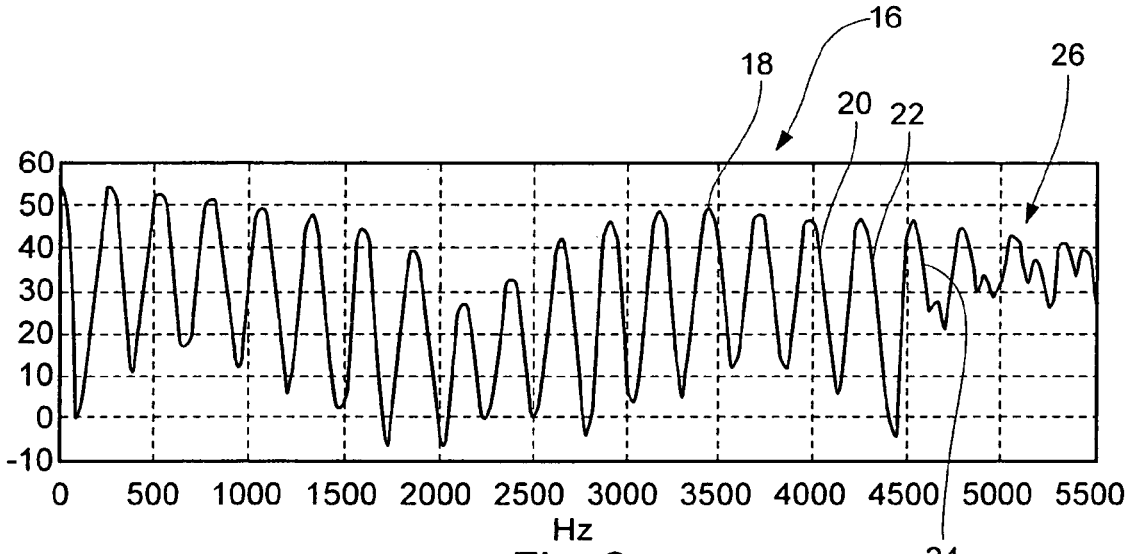
FIG. 3 shows a spectrum of the band-limited harmonic signal of FIG. 2 after the signal has been squared in the time domain.

The present system and methods for extending the bandwidth of harmonic signals operate in a manner similar to the method described in the Background section of introducing harmonics by creating harmonic distortion in the time domain. However, whereas past efforts of introducing or reintroducing harmonic content through harmonic distortion rely on a non-linear transformation of the band-limited signal in the time domain, the system and methods disclosed herein rely on a transformation of the band-limited signal in the frequency domain instead. As noted in the background of the invention, a non-linear transformation in the time domain may be accomplished by squaring the original time domain signal x(n) as represented by the equation.

$$y(n)=x^2(n) \tag{1}$$

where n denotes the time index and y is the transformed output signal which includes the harmonic distortion that produces harmonics at a wider bandwidth. Squaring the time sampled signal in the time domain is equivalent to performing circular or cyclic convolution of the signal's complex spectrum with itself in the frequency domain. However, circular convolution in the frequency domain suffers from the same defects as squaring the time domain signal, namely aliasing artifacts as shown in FIG. 3. By using linear convolution to convolve the complex spectrum of the signal with itself rather than circular convolution, the aliasing artifacts are eliminated. Thus, the present system and methods for extending the frequency bandwidth of harmonic signals employ linear convolution to convolve the frequency domain complex spectrum of the harmonic signal with itself. The linear convolution operation may be expressed as $$Y(k)=X(k)*X(k)\ k=O\ldots N/2 \tag{2}$$

where * denotes a linear convolution operation, k is the frequency index, and N is the length of the FFT employed to transform the time domain signal into the frequency domain. Note that the Figures showing frequency spectra in this document were generated using a digital signal sampled at 11 kHz transformed using a 256-pt FFT on hanning-windowed time segments, with 50% overlap. Other sampling rates, windowing functions or FFT sizes may also be used for this invention.

Figure 1:
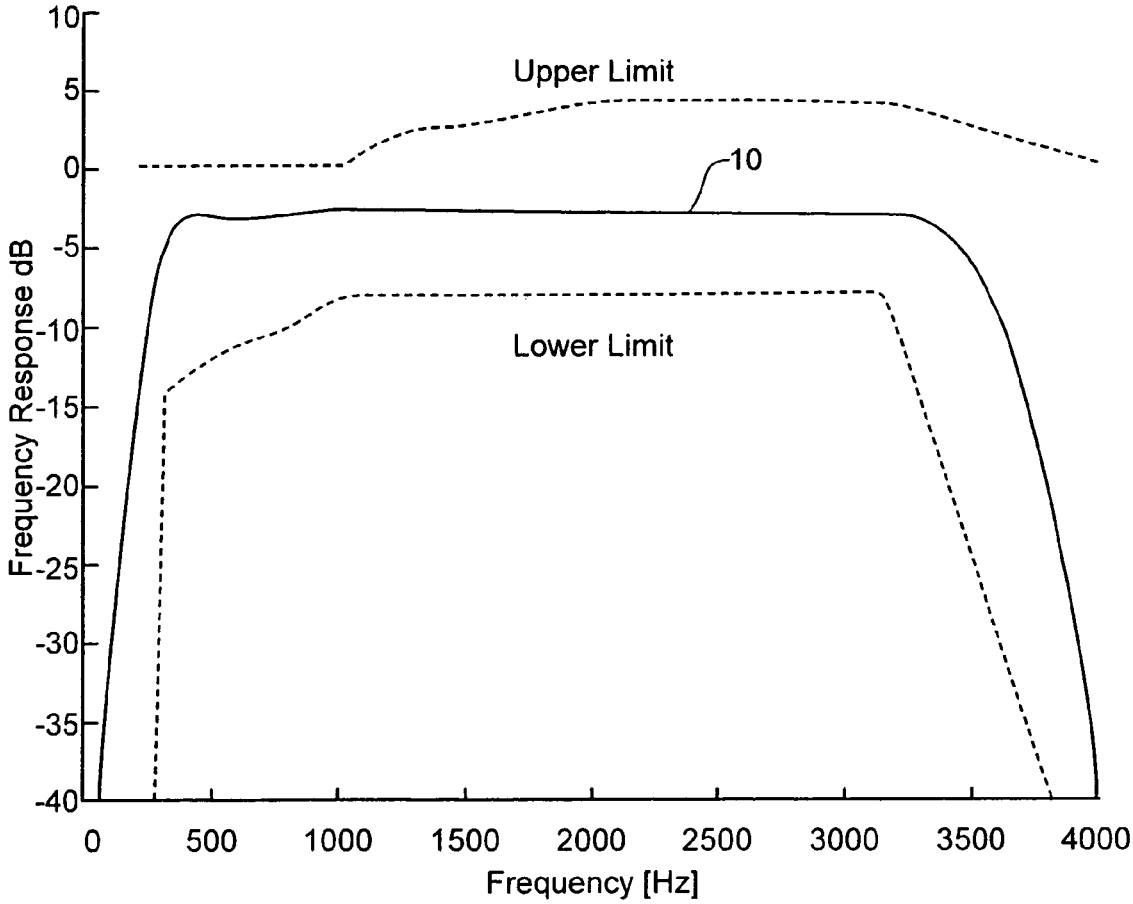
FIG. 1 shows a typical passband for a telephone system.
Figure 2:
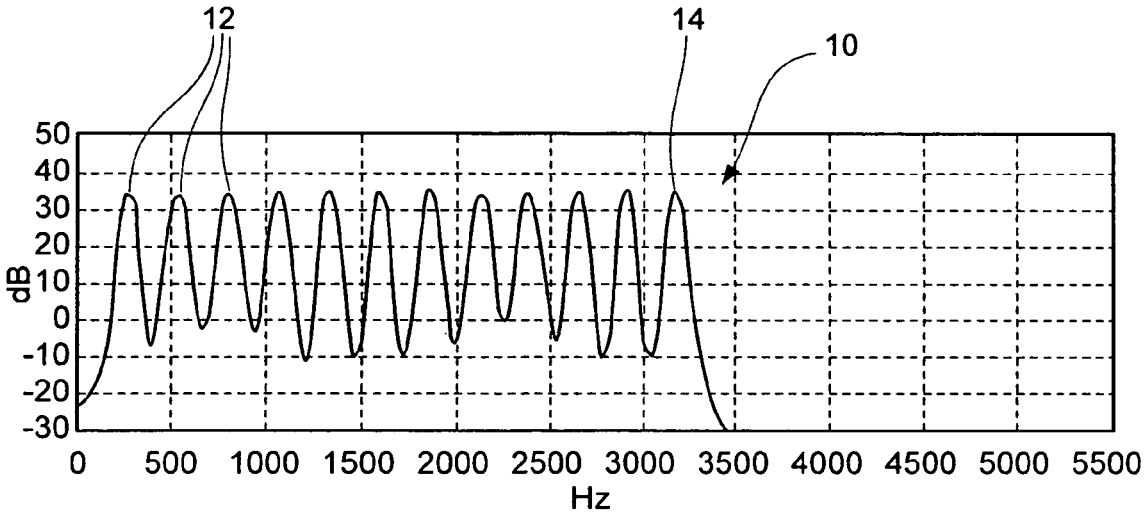
FIG. 2 shows a spectrum of a band-limited harmonic signal.
Figure 4:
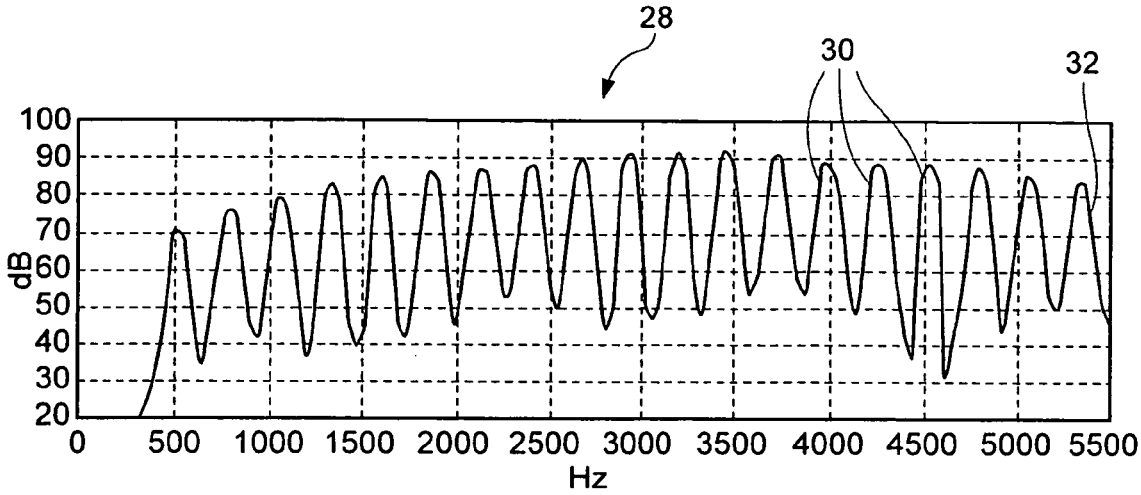
FIG. 4 shows a spectrum of the band-limited harmonic signal of FIG. 2 after a non-linear transformation in the frequency domain.

FIG. 4 shows a spectrum 28 that results from linearly convolving the spectrum 10 of a band-limited harmonic signal shown in FIG. 1 with itself. The creation of additional higher frequency harmonics is clearly evident. The spectrum 10 of the band-limited signal is limited to twelve harmonic peaks, such as peaks 12, with the highest frequency harmonic peak 14 occurring at approximately 3200 Hz. The harmonically expanded spectrum 28 in FIG. 4, however, includes eight extended harmonic peaks 30 in the frequency range between 3500 and 5500 Hz, with the highest frequency harmonic 32 located at approximately 5300 Hz.

It is also clear that the aliasing artifacts 26 which are prevalent in the higher frequencies of the spectrum 16 when a non-linear transform is performed in the time domain are not present in the spectrum 28 resulting from a linear convolution in the frequency domain. An additional advantage of performing linear convolution of the complex spectrum of the harmonic signal with itself in the frequency domain is that it is easier to control the bandwidth of the generated harmonics. For example, in FIG. 3 adding non-linear distortion to a harmonic signal in the time domain creates harmonics across all frequencies. However, employing linear convolution in the frequency domain as described herein, the filtered output Y(k) (Eq. 2) need only be calculated for frequency points k where harmonic extension of the signal is desired. For example, if it is desirable to only generate harmonics above 3400 Hz then the filtered output Y(k) need only be calculated for frequencies greater than 3400 Hz.

In the preceding example, the harmonic range of the spectrum 10 of the original band-limited signal was extended from approximately 3500 Hz to 5,500 Hz. Performing a non-linear transformation in the frequency domain may also be used to extend harmonics from higher frequency ranges to lower frequency ranges, although a slightly different approach must be employed. In order to introduce harmonics in frequencies below the frequencies of the harmonics of the original band-limited signal, the mirrored complex conjugate of the original complex spectrum of the band-limited signal is used. The original complex spectrum of the band-limited signal is convolved with a mirrored complex conjugate version of itself. This operation may be expressed mathematically as $$Y'(k)=X(k)*\mathrm{conj}(X(N/2-k))\ k=0\ldots N/2, \tag{3}$$

where conj represents the complex conjugate of the complex spectrum. The final output Y(k), the spectrum including lower frequency harmonics, is obtained by again mirroring and taking the complex conjugate of the result of the linear convolution Y'(k). This may be expressed as $$Y(k)=\mathrm{conj}(Y'(N/2-k))\ k=0\ldots N/2. \tag{4}$$

As was the case when extending harmonics to higher frequencies, the filtered output Y(k) need only be calculated for points k where harmonic extension of the signal are desired.

Figure 5:
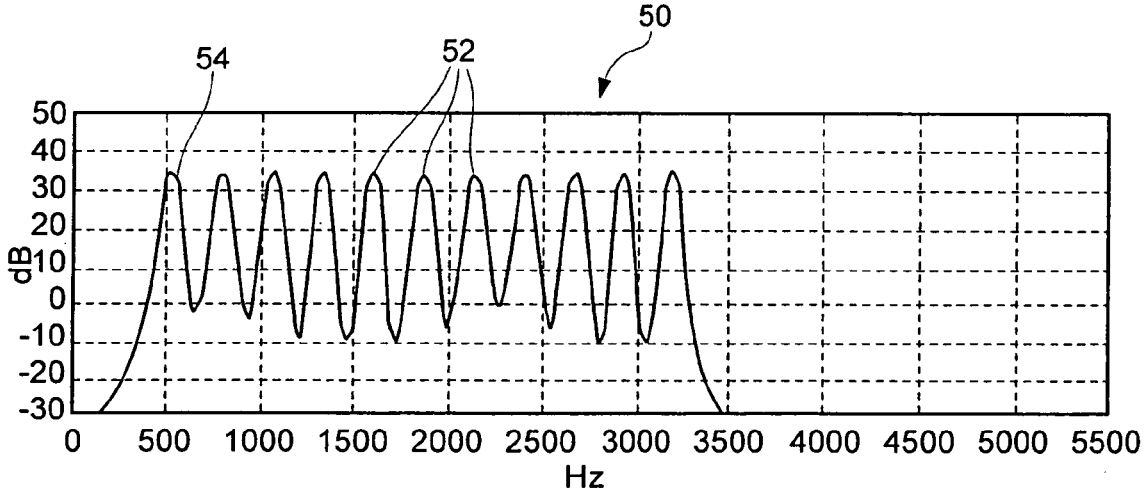
FIG. 5 shows a spectrum of a band-limited harmonic signal absent a low frequency harmonic peak due to the passband for a typical telephone system.
Figure 6:
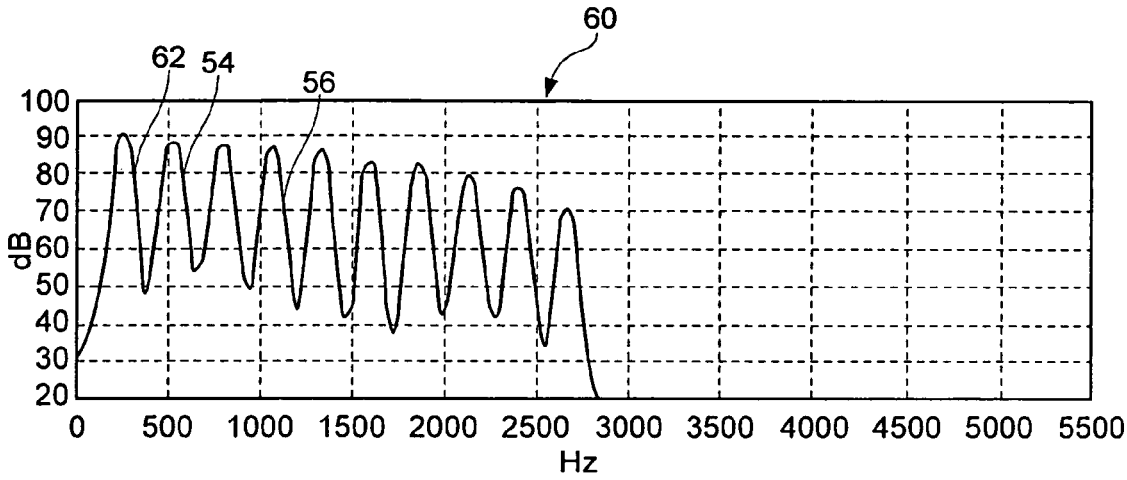
FIG. 6 shows a spectrum of the band-limited harmonic signal of FIG. 5 having a harmonic peak extended into the low frequency range.

FIG. 5 shows the spectrum 50 of a band-limited harmonic signal. The spectrum 50 is characterized by a plurality of harmonic peaks 52, the lowest harmonic peak 54 located at approximately 500 Hz. FIG. 6 shows a frequency spectrum 60 which results from linearly convolving the original spectrum 50 of FIG. 5 with the mirrored complex conjugate of itself as described above. An additional harmonic peak 62 is clearly visible at approximately 250 Hz, thus confirming that linear convolution of the original spectrum with the mirrored complex conjugate of itself operates to extend harmonics into lower frequency ranges.

Using the system and methods of extending harmonic information in band-limited signals discussed herein, it may be desirable to linearly convolve only portions of the original complex spectrum with itself. For example, for phone-band speech signals, the most significant harmonic energies are usually contained within the frequency range between 0-2.5 KHz. Therefore, in order to reduce the computational load on the system, it may be desirable to use only the portion of the original complex spectrum for the convolution where most of the harmonic energy resides. The linear convolution equation (2) described above may be altered as $$Y(k)=X(k_1)*X(k_2)\ k_1=0\ldots M_1 \tag{5}$$

$$k_2=0\ldots M_2$$

where $$M_1,\ M_2<\frac{N}{2}.$$

Limiting the portions of the complex spectrum which are used in performing the linear convolution may also be effective when a portion of the original harmonic signal has been corrupted by noise. Generation of additional harmonics may be more effective when portions of the spectrum having the low signal-to-noise ratio (SNR) are excluded from the linear convolution.

Figure 7:
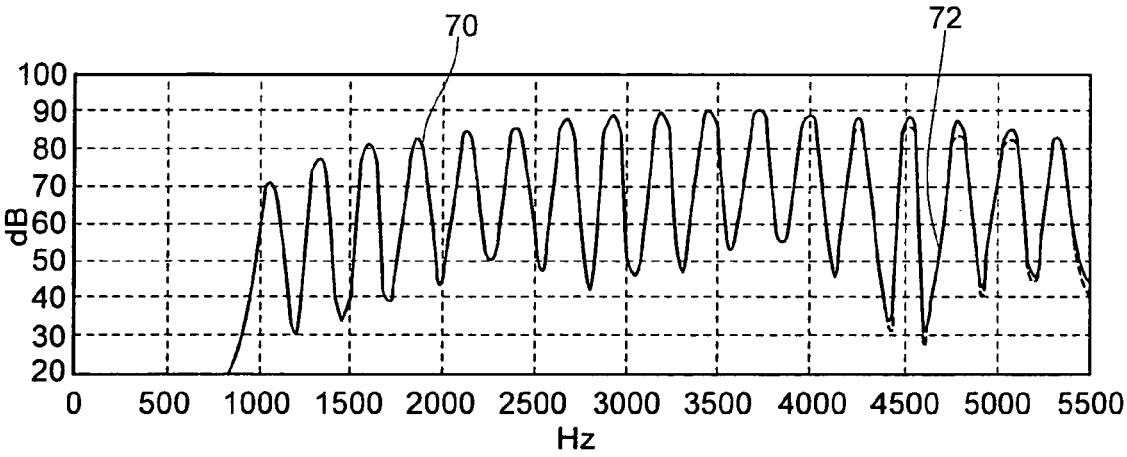
FIG. 7 shows two extended spectra for the band-limited harmonic signal of FIG. 5, the first after full linear convolution of the entire complex spectrum with itself, the second after linear convolution of the complex spectrum with only a portion of itself.

FIG. 7 shows two substantially similar spectrums 70, 72. Both spectrums 70, 72 were produced using Equation (5). For the solid line spectrum the values $M_1$ and $M_2$ were selected such that $M_1=M_2=N/2$. In this case, Equation (5) reduces to Equation (2), and the solid line spectrum 70 represents the entire original spectrum 50 linearly convolved with itself. For the dashed line spectrum 72, however, the values for $M_1$ and $M_2$ were selected such that $M_1=N/2$ and $M_2=N/4$. This amounts to the original complex spectrum being linearly convolved with only ½ of itself. Nonetheless, the dashed line spectrum 72 only varies from the solid line spectrum 70 by an insignificant amount. Thus, reducing the complex filter coefficients as described, reduces the computational load, and generates an extended harmonic spectrum wherein the strength of the generated harmonics is not significantly affected.

As mentioned above, excluding a portion of the original complex spectrum from the linear convolution may be beneficial where portions of the original signal are corrupted by noise. Another alternative for excluding low SNR portions of the spectrum is to use a weighted convolution approach. In some cases it may be advantageous to exclude or suppress portions of a spectrum prior to performing the linear convolution. This may be accomplished by multiplying the spectrum by one or more weighting factors before performing the convolution. In this case, Equation (4) may be re-written as $$Y(k)=[G_1(k_1)X(k_1)]*[G_2(k_2)X(k_2)]\ k_1=0\ldots M_1\ (6$$

$$k_2=0\ldots M_2$$

where $M_1$, $M_2<N/2$ and $G_1$ and $G_2$ are weighting factor vectors. Appropriate values for $G_1$ and $G_2$ may be for example between 0 and 1. In a particular implementation for suppressing background noise and generating extended harmonics in a speech signal corrupted by background noise, $G_1$ and $G_2$ may correspond to Weiner filter coefficients estimated from SNR characteristics of the original spectrum of the input speech signal.

Figure 8:
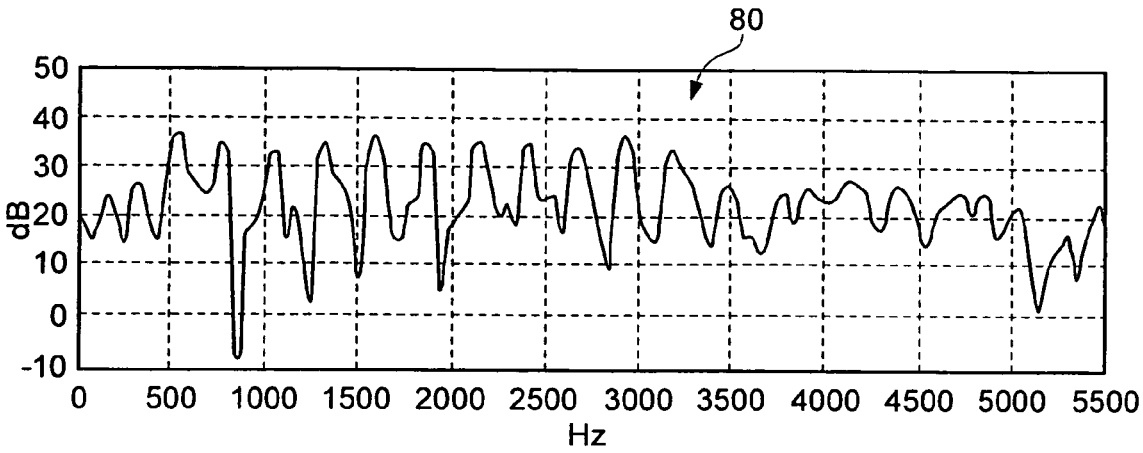
FIG. 8 shows a frequency spectrum of a harmonic signal which has been corrupted by noise.
Figure 9:
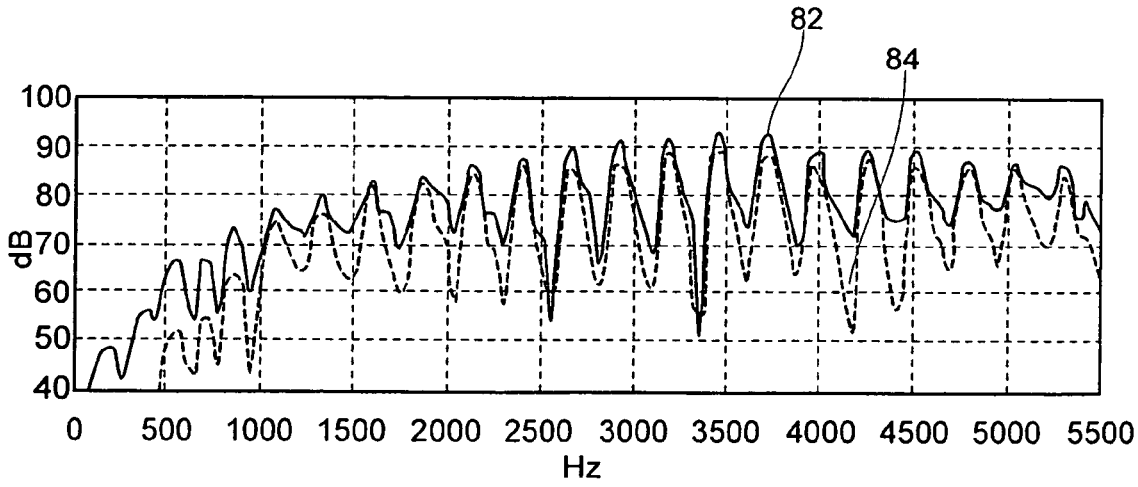
FIG. 9 shows two frequency spectrums, the first corresponding to the linear convolution of the corrupted harmonic spectrum of FIG. 7 with itself and the second corresponding to a weighted convolution.

FIG. 8 shows the spectrum 80 of a band-limited harmonic signal corrupted by white noise. FIG. 9 shows two spectrums 82, 84 that result from convolving the spectrum 80 with itself according to Equation (6). The first, solid line spectrum 82 corresponds to weighting factors $G_1$, $G_2$=1, in other words no weighting. The second dashed line spectrum 84 corresponds to weighting factors $G_1$, $G_2$ which are SNR weighted using Weiner filter coefficients (max. noise attenuation of 12 dB). The spectrum 84 produced from the SNR weighted convolution procedure, includes much deeper valleys between the harmonic peaks, indicating harmonics that are more clearly defined and less corrupted by noise.

Figure 10:
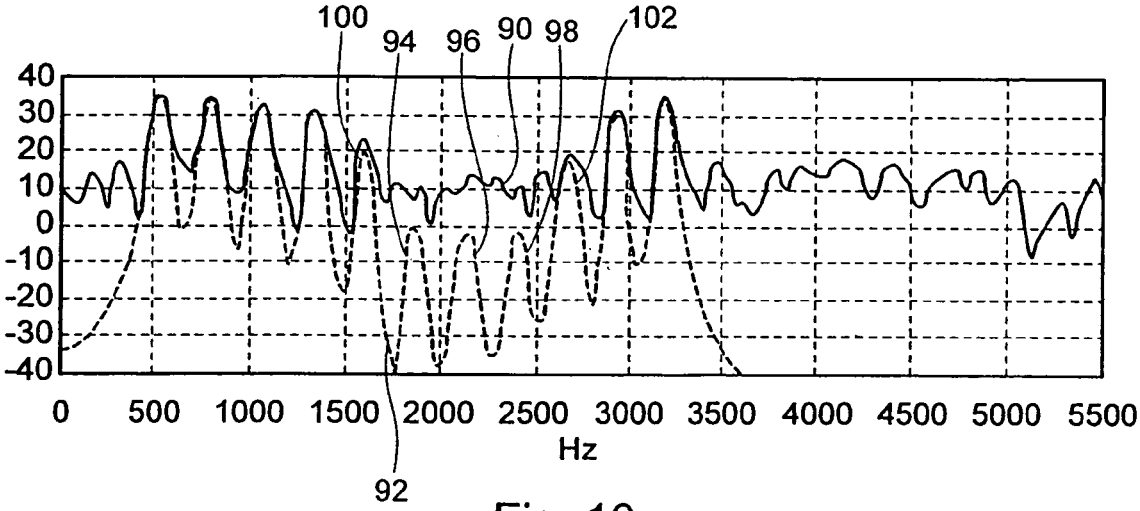
FIG. 10 shows the spectrum of a band-limited harmonic signal wherein some of the harmonic peaks have been masked by background noise.
Figure 11:
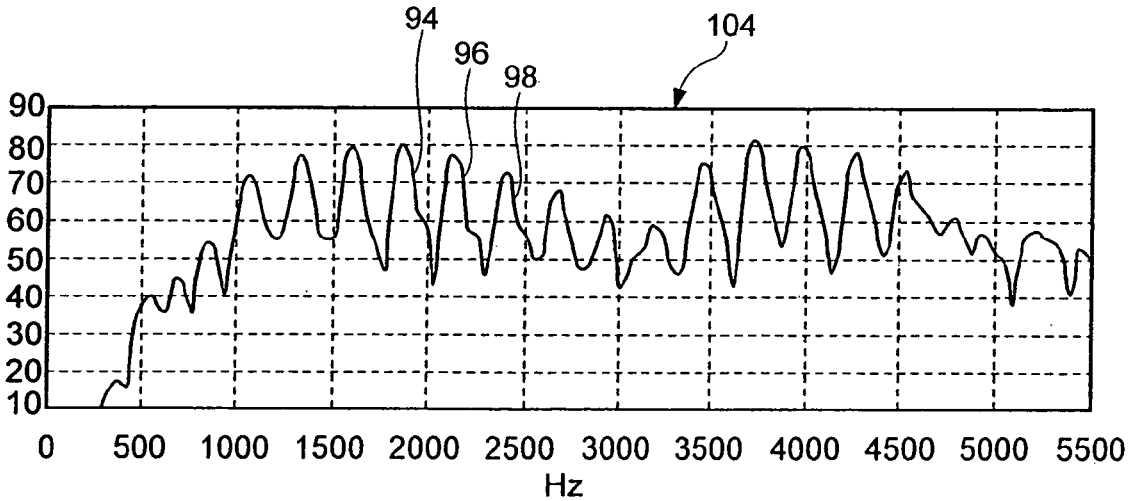
FIG. 11 shows the spectrum of FIG. 10 after an SNR-weighted convolution operation.

The weighted convolution procedure embodied in Equation (6) may also be employed to recover or enhance in-band harmonics that have been completely or partially masked by noise. For example FIG. 10 shows a frequency spectrum 90 which has been corrupted by noise. FIG. 10 also shows the original uncorrupted spectrum 92 as a dashed line. Comparing the noise corrupted spectrum 90 with the original harmonic signal spectrum 92, it is clear that harmonic peaks 94, 96 98 are completely masked by the background noise, and harmonic peaks 100, 102 are barely discernable. Applying the SNR-weighted convolution operation described above results in the frequency spectrum 104 shown in FIG. 11. In the spectrum 104 the masked harmonic peaks have been restored, and additional harmonics have been generated at frequencies above 3.4 kHz. Furthermore, as described in the co-pending U.S. patent application Ser. No. 11/110,556, entitled "System for Improving Speech Quality and Intelligibility", the original spectrum 90 may be blended with the harmonic-extended spectrum 104. This may result in a final signal containing not only extended high-frequency harmonics (e.g. above 3.4 kHz), but also reconstructed harmonics that were masked by background noise.

Figure 12:
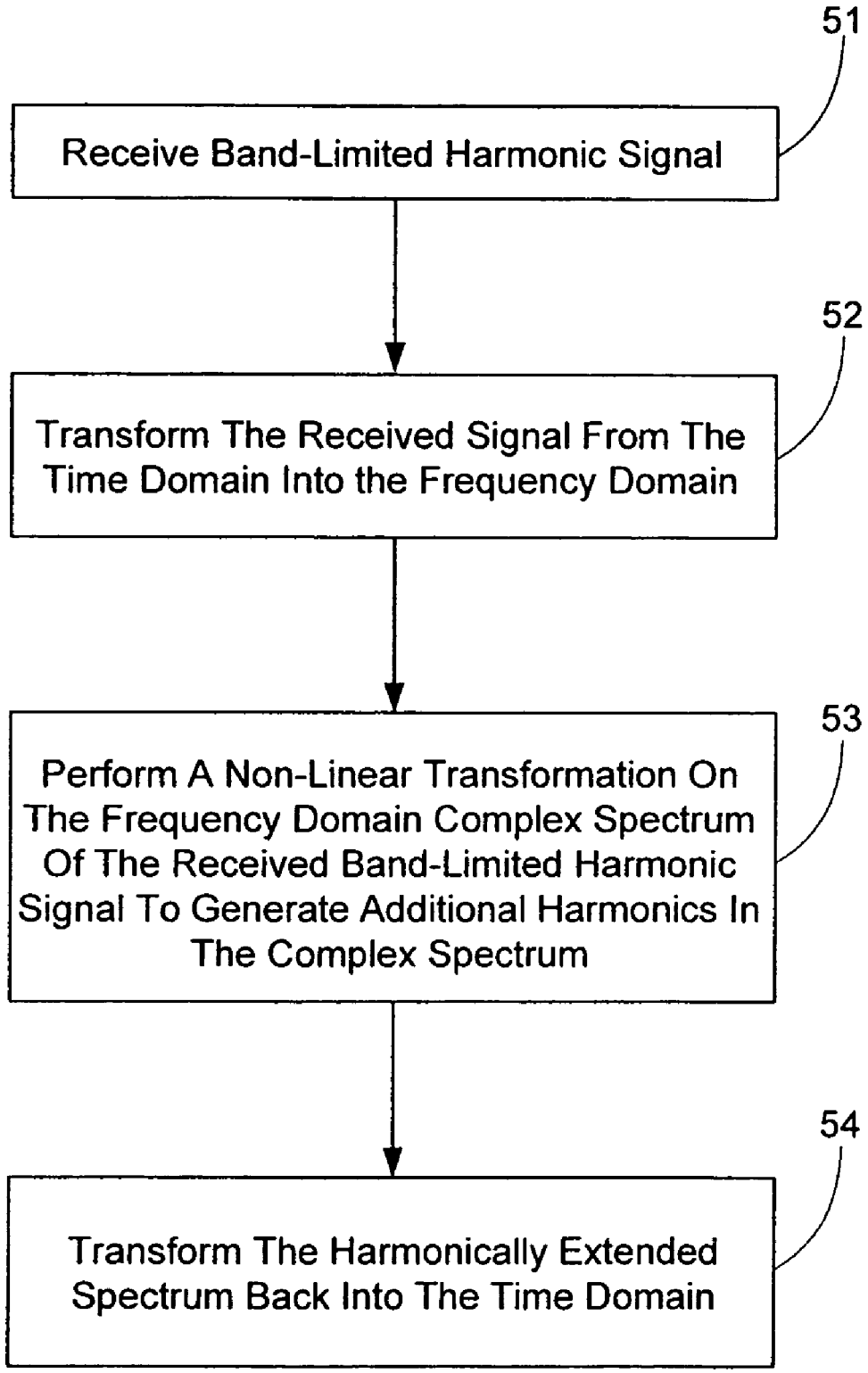
FIG. 12 is a flowchart of a method of extending the harmonics of a band-limited harmonic signal.

Based on the above discussion, a flowchart describing a method for extending the bandwidth of a band-limited harmonic signal is shown in FIG. 12. The first step S1 is to receive a time based bandwidth limited harmonic signal. The signal may be for example a voice signal received over a wireless network. The second step S2 is to transform the received time domain signal into the frequency domain, to obtain the frequency spectrum of the received signal. The transform may be performed via an FFT, a Discrete Fourier Transform (DFT); a Discrete Cosine Transform (DCT); a digital filter bank; wavelet transform, or some other method for converting a digitally sampled time domain signal into the frequency domain. In step S3 a non-linear transformation is performed on the complex spectrum. As described above, the non-linear transformation in the frequency domain may include linear convolution of the complex spectrum of the transformed signal with itself, linear convolution of the complex spectrum or a portion of the complex spectrum with a portion of itself, convolution of the complex spectrum with the mirrored complex conjugate of itself, convolution of a first weighted version of the complex spectrum with a second weighted version of the complex spectrum, or some other non-linear frequency domain transformation that will generate the desired harmonics. The final step S4 is to transform the spectrum, including the newly created harmonics, back into the time domain. This may be accomplished by Inverse FFT, Inverse Discrete Fourier Transform (IDFT); Inverse Cosine Transform (IDCT); a digital filter bank; or inverse wavelet transform or some other method for converting a frequency domain signal back into the time domain. Preferably, the reverse transformation back into the time domain will be accomplished via the inverse of the transform originally used to transform the time domain signal into the frequency domain.

Figure 13:
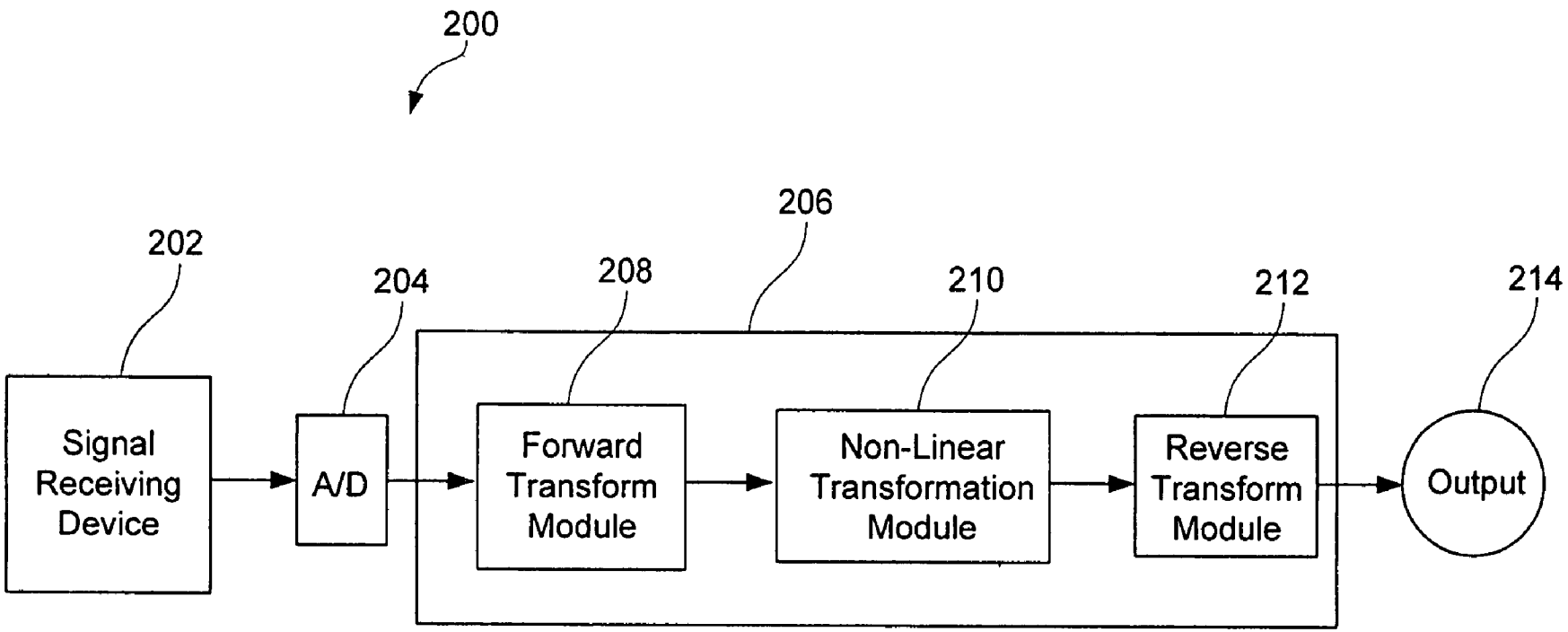
FIG. 13 is a block diagram of a system for extending the harmonics of a band-limited harmonic signal.

FIG. 13 shows a block diagram of a system 200 for extending the harmonic content of a band-limited harmonic signal. The system 200 includes a signal receiving device 202. The signal receiving device 202 may be a microphone, a wireless telephone, an audio recording device, or any other device capable of receiving or producing an audio signal. The audio signal output by the signal receiving device 202 may be either analog or digital. If the received signal is analog an A/D converter 204 may be provided to convert the received analog audio signal into a digital audio signal. Otherwise, the A/D converter 204 may be omitted. The digital audio signal is input to an harmonic extender 206. The harmonic extender 206 includes a forward transform module 208 for transforming the received audio signal into the frequency domain. The forward transform module 208 may employ an FFT algorithm, a Discrete Fourier Transform (DFT); a Discrete Cosine Transform (DCT); a digital filter bank; or a wavelet transform, or some other mechanism for transforming the time domain audio signal into the frequency domain.

The harmonic extender 206 further includes a non-linear transform module 210. The harmonic generation module 210 performs a non-linear transformation on the complex spectrum of the received audio signal which is output from forward transform module 208. The non-linear transformation may include linear convolution of the complex spectrum of the transformed signal with itself; linear convolution of the complex spectrum or a portion of the complex spectrum with a portion of itself; convolution of the complex spectrum with the mirrored complex conjugate of itself; convolution of a first weighted version of the complex spectrum with a second weighted version of the complex spectrum; or some other non-linear frequency domain transformation that will generate the desired harmonics.

Once the additional harmonics have been generated, an inverse, or reverse transform module 212 transforms the harmonically extended spectrum back into the time domain. The reverse transform module 212 may employ an inverse FFT algorithm, an Inverse Discrete Fourier Transform (IDFT); an Inverse Digital Cosine Transform (IDCT); a digital filter bank; or a wavelet transform or some other mechanism for transforming the complex spectrum of the harmonically extended signal back into the time domain. Preferably, the reverse transform module 212 will employ the inverse of the transform employed by the forward transform module 208. The reverse transform module 212 outputs a time domain signal 214 which includes harmonics in frequencies outside the limited frequency band of the original signal.

Figure 14:
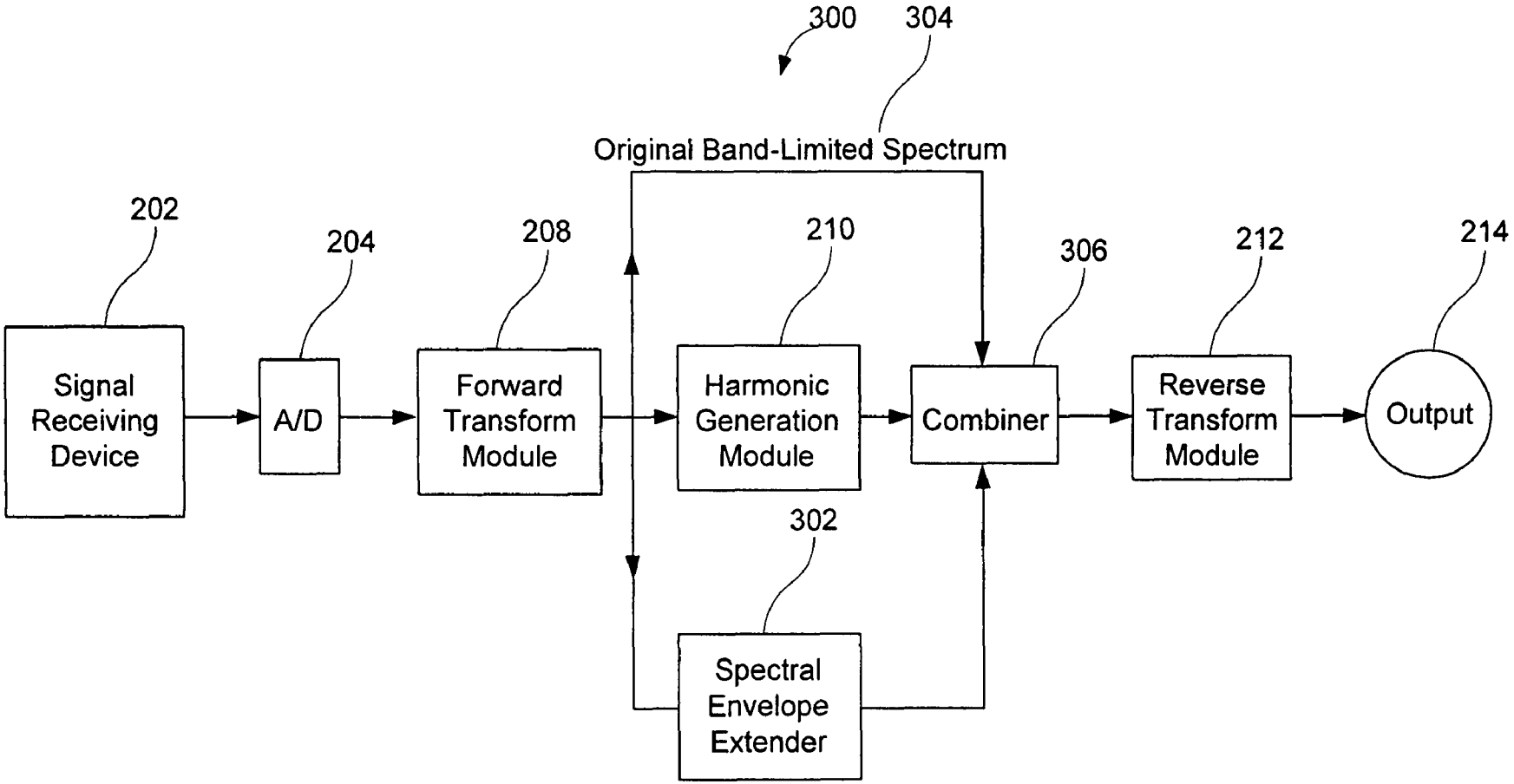
FIG. 14 is a block diagram of a system for extending the harmonics and spectral envelope of a band-limited harmonic signal and combining the extended signal with the original band-limited signal.

FIG. 14 shows a block diagram of a system 300 for extending the harmonic content and spectral envelope of a band-limited harmonic and combining the extended signal with the original band-limited signal. Such a system is also described in the co-pending U.S. patent application Ser. No. 11/110,556, entitled "System for Improving Speech Quality and Intelligibility". The combiner module 306 blends the original band-limited spectrum 304 with the output from the harmonic generation module 210 and the output from the spectral envelope extender 302. The spectral envelope extender 302 ensures the spectral envelope of the harmonic generator's output 210 will be complimentary to that of the original band-limited spectrum 304. Therefore, the final output signal 308 may have improved bandwidth, quality and intelligibility compared to the band-limited received input signal 202.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A computer-implemented method of extending harmonics of a band-limited harmonic signal through the use of a processor, the method comprising:

transforming, through the use of a processor, a band-limited harmonic signal from a time domain to a frequency domain to obtain a complex spectrum of the band-limited harmonic signal;

performing, through the use of the processor, a non-linear transformation on the complex spectrum of the band-limited harmonic signal in the frequency domain which extends harmonic content of the band-limited harmonic signal to frequencies above an upper frequency limit of the band-limited harmonics signal, where the non-linear transformation comprises performing a linear convolution; and inverse transforming, through the use of the processor, the extended complex spectrum of the band-limited harmonic signal back into the time domain.

2. The method of claim 1 where the step of transforming the band-limited harmonic signal from the time domain to the frequency domain comprises performing a Fast Fourier Transform (FFT) on the band-limited harmonic signal.

3. The method of claim 2 where the step of performing the linear convolution comprises performing a linear convolution on the complex spectrum of the band-limited harmonic signal with itself.

4. The method of claim 3 where the linear convolution is performed according to a formula $Y(k)=X(k)*X(k)$; $k=0 \ldots N/2$; where * denotes a linear convolution operation, k is a frequency index and N is a length of the FFT used in transforming the band-limited harmonic signal from the time domain to the frequency domain.

5. The method of claim 2 where the step of performing the linear convolution comprises performing a linear convolution on the spectrum of the band-limited harmonic signal weighted by a first weighting factor and the complex spectrum of the band-limited harmonic signal weighted by a second weighting factor.

6. The method of claim 2 where the step of performing the linear convolution comprises performing a linear convolution of a portion of the complex spectrum of the band-limited harmonic signal with a portion of the complex spectrum of the band-limited harmonic signal.

7. The method of claim 1 where the step of transforming the band-limited harmonic signal from the time domain to the frequency domain comprises employing one of:

a Discrete Fourier Transform (DFT);

a Discrete Cosine Transform (DCT);

a filter bank; or a wavelet transform.

8. The method of claim 1, where performing a linear convolution reduces aliasing artifacts.

9. The method of claim 1, where the linear convolution is performed according to a formula $Y(k)=[G_1(k_1)X(k_1)]*[G_2(k_2)X(k_2)]$; $k_1=0 \ldots M_1$; $k_2=0 \ldots M_2$; $M_1, M_2 < N/2$; where * denotes a linear convolution operation, $k_1$ is a first frequency index, $k_2$ is a second frequency index, $G_1$ is a first weighting factor, $G_2$ is a second weighting factor, and N is a length of a Fast Fourier Transform used in transforming the band-limited harmonic signal from the time domain to the frequency domain.

10. The method of claim 1, further comprising where a portion of the band-limited harmonic signal is corrupted by noise; and where a portion of the complex spectrum of the band-limited harmonic signal corresponding to the portion of the band-limited harmonic signal corrupted by noise is excluded from the complex spectrum of the band-limited harmonic signal before beginning the step of performing, through the use of a processor, a non-linear transformation on the complex spectrum of the band-limited harmonic signal in the frequency domain.

11. A computer-implemented harmonic extension method comprising:

receiving a band-limited harmonic signal having significant signal energies at regular frequency intervals within a limited frequency band defined by a passband lower frequency limit and a passband upper frequency limit;

transforming, through the use of a processor, the band-limited harmonic signal from a time domain to a frequency domain to obtain a complex spectrum of the band-limited harmonic signal;

performing, through the use of the processor, a first non-linear transformation of the complex spectrum of the band-limited harmonic signal in the frequency domain which extends harmonic content of the band-limited harmonic signal to frequencies below the passband lower frequency limit where a lower extended spectrum has harmonic energy at at least one harmonic frequency at which harmonic energy was absent in the band-limited harmonic signal, where the first non-linear transformation comprises performing a linear convolution on the complex spectrum of the band-limited harmonic signal with a mirrored complex conjugate of the complex spectrum of the band-limited harmonic signal;

performing, through the use of the processor, a second non-linear transformation of the complex spectrum of the band-limited harmonic signal in the frequency domain which extends harmonic content of the band-limited harmonic signal to frequencies above the passband upper frequency limit where an upper extended spectrum has harmonic energy at at least one harmonic frequency at which harmonic energy was absent in the band-limited harmonic signal, where the second non-linear transformation comprises performing a linear convolution on the complex spectrum of the band-limited harmonic signal with itself; and transforming, through the use of the processor, the lower extended spectrum and the upper extended spectrum into the time domain.

12. The method of claim 11 where the step of transforming the band-limited harmonic signal from the time domain to the frequency domain comprises performing a Fast Fourier Transform on the band-limited harmonic signal.

13. The method of claim 12 where the step of performing the linear convolution on the complex spectrum of the band-limited harmonic signal with itself further comprises performing a linear convolution on the spectrum of the band-limited harmonic signal weighted by a first weighting factor and the complex spectrum of the band-limited harmonic signal weighted by a second weighting factor.

14. The method of claim 12 where the step of performing the linear convolution on the complex spectrum of the band-limited harmonic signal with a mirrored complex conjugate of the complex spectrum of the band-limited harmonic signal further comprises performing a linear convolution of a portion of the complex spectrum of the band-limited harmonic signal with a portion of the mirrored complex conjugate of the complex spectrum of the band-limited harmonic signal.

15. The method of claim 11 where the step of transforming the band-limited harmonic signal from the time domain to the frequency domain comprises employing one of:

a Discrete Fourier Transform (DFT);

a Discrete Cosine Transform (DCT);

a digital filter bank; or a wavelet transform.

16. The method of claim 11, where the linear convolution performed on the complex spectrum of the band-limited harmonic signal with the mirrored complex conjugate of the complex spectrum of the band-limited harmonic signal is performed according to a formula $Y(k)=X(k)*conj(X(N-k))$ $k=0 \ldots N/2$; where * denotes a linear convolution operation, k is a frequency index and N is a length of a Fast Fourier Transform used in transforming the band-limited harmonic signal from the time domain to the frequency domain.

17. A system for extending harmonics of a band-limited harmonic signal, the system comprising:

means for receiving a band-limited harmonic signal;

a signal processor having a forward transform module that transforms the band-limited harmonic signal from a time domain into a complex spectrum of the band-limited harmonic signal in a frequency domain; and a harmonic generation module that performs a non-linear transformation of the complex spectrum of the band-limited harmonic signal in the frequency domain, the non-linear transformation comprising a linear convolution in the frequency domain that extends harmonic content of the band-limited harmonic signal to a frequency above an upper frequency limit of the band-limited harmonic signal; and a reverse transform module that transforms the harmonically extended spectrum of the band-limited harmonic signal back to the time domain.

18. The system of claim 17 where the forward transform employed is one of a Fast Fourier Transform (FFT); a Discrete Fourier transform (DFT); a Discrete Cosine Transform (DCT); a digital filter bank; or a wavelet transform to transform the band-limited harmonic signal into the frequency domain.

19. The system of claim 17 where the linear convolution is performed on the complex spectrum of the band-limited harmonic signal with itself.

20. The system of claim 17 where the linear convolution is performed on the complex spectrum of the band-limited harmonic signal weighted by a first weighting factor, with the complex spectrum of the band-limited harmonic signal weighted by a second weighting factor.

21. A system for extending harmonics and a spectral envelope of a band-limited harmonic signal and combining an extended signal with the band-limited harmonic signal, the system comprising:

means for receiving a band-limited harmonic signal;

a signal processor having a forward transform module that transforms the band-limited harmonic signal from a time domain into a complex spectrum of the band-limited harmonic signal in a frequency domain;

a harmonic generation module that performs a non-linear transformation of the complex spectrum of the band-limited harmonic signal in the frequency domain that extends harmonic content of the band-limited harmonic signal to frequencies above an upper frequency limit of the band-limited harmonic signal, the non-linear transformation comprising a linear convolution in the frequency domain;

a spectral envelope extender module to ensure the spectral envelope of the harmonically extended spectrum of the band-limited harmonic signal is complimentary to that of the band-limited signal;

a combiner module that combines the harmonically extended spectrum of the band-limited harmonic signal with a spectrum of the band-limited harmonic signal to create a final frequency extended harmonic spectrum; and a reverse transform module for transforming the final frequency extended harmonic spectrum back to the time domain.

22. The system of claim 21 where the forward transform employed is one of a Fast Fourier Transform (FFT); a Discrete Fourier transform (DFT); a Discrete Cosine Transform (DCT); a digital filter bank; or a wavelet transforms to transform the band-limited harmonic signal into the frequency domain.

23. The system of claim 21 where the linear convolution is performed on the complex spectrum of the band-limited harmonic signal with itself.

24. The system of claim 21 where the linear convolution is performed on the complex spectrum of the band-limited harmonic signal weighted by a first weighting factor with the complex spectrum of the band-limited harmonic signal weighted by a second weighting factor.

25. A system for extending harmonics of a band-limited harmonic signal, the system comprising:

means for receiving a band-limited harmonic signal;

a signal processor having a forward transform module that transforms the band-limited harmonic signal from a time domain into a complex spectrum of the band-limited harmonic signal in a frequency domain; and a harmonic generation module that performs a first non-linear transformation of the complex spectrum of the band-limited harmonic signal in the frequency domain, the first non-linear transformation comprising a first linear convolution in the frequency domain that extends harmonic content of the band-limited harmonic signal to a frequency above an upper frequency limit of the band-limited harmonic signal, and that performs a second non-linear transformation of the complex spectrum of the band-limited harmonic signal in the frequency domain, the second non-linear transformation comprising a second linear convolution in the frequency domain that extends harmonic content of the band-limited harmonic signal to a frequency below a lower frequency limit of the band-limited harmonic signal; and a reverse transform module that transforms harmonic content of the band-limited harmonic signal extended to the frequency above the upper frequency limit of the band-limited harmonic signal and harmonic content of the band-limited harmonic signal extended to the frequency below the lower frequency limit of the band-limited harmonic signal into the time domain.

26. The system of claim 25 where the first linear convolution comprises a linear convolution of the complex spectrum of the band-limited harmonic signal convolved with itself.

27. The system of claim 25 where the second linear convolution comprises a linear convolution of the complex spectrum of the band-limited harmonic signal convolved with a mirrored complex conjugate of the complex spectrum of the band-limited harmonic signal.

* * * * *

UNITED STATES PATENT AND TRADEMARK OFFICE

CERTIFICATE OF CORRECTION

PATENT NO. : 8,311,840 B2
APPLICATION NO. : 11/168654
DATED : November 13, 2012
INVENTOR(S) : David Giesbrecht et al.

It is certified that error appears in the above-identified patent and that said Letters Patent is hereby corrected as shown below:

On the Title Page

Right column, line 7, under "ABSTRACT", before "by a linear convolution of the complex" replace "accomplishes" with --accomplished--.

Signed and Sealed this
Fifth Day of March, 2013

Teresa Stanek Rea
*Acting Director of the United States Patent and Trademark Office*